US009736560B2

(12) United States Patent
McGarry et al.

(10) Patent No.: US 9,736,560 B2
(45) Date of Patent: Aug. 15, 2017

(54) LIQUID IMPERMEABLE SEALED SPEAKER DESIGN

(71) Applicant: Logitech Europe S.A, Lausanne (CH)

(72) Inventors: Steve McGarry, Vancouver, WA (US); Steven Warren Pooler, Vancouver, WA (US); Donald Robert Mayette, Vancouver, WA (US)

(73) Assignee: Logitech Europe S.A., Lausanne (CH)

( * ) Notice: Subject to any disclaimer, the term of this patent is extended or adjusted under 35 U.S.C. 154(b) by 0 days.

(21) Appl. No.: 14/867,857

(22) Filed: Sep. 28, 2015

(65) Prior Publication Data

US 2017/0078775 A1 Mar. 16, 2017

Related U.S. Application Data

(60) Provisional application No. 62/218,502, filed on Sep. 14, 2015.

(51) Int. Cl.
*H04R 25/00* (2006.01)
*H04R 1/02* (2006.01)
*H04R 31/00* (2006.01)

(52) U.S. Cl.
CPC ..... *H04R 1/02* (2013.01); *H04R 31/00* (2013.01); *H04R 2201/029* (2013.01)

(58) Field of Classification Search
CPC . H04R 1/02; H04R 1/06; H04R 1/025; H04R 1/026; H04R 1/28; H04R 31/00; H04R 31/003; H04R 31/006; H04R 2201/00; H04R 2201/025; H04R 2201/028; H04R 2201/029; H04R 2205/021; H04R 2420/03; H01R 9/032; H01R 9/091
USPC ..... 381/332, 334, 384, 394, 395; 439/607.51, 607.57, 607.58
See application file for complete search history.

(56) References Cited

U.S. PATENT DOCUMENTS 7,452,247 B1 * 11/2008 Rahman ..... B29C 45/1671 264/272.11
7,876,923 B2 1/2011 Finnegan et al.
(Continued)

OTHER PUBLICATIONS

TE, TE-IP68, 2014, p. 1-10.*
(Continued)

*Primary Examiner* — William A Jerez Lora
(74) *Attorney, Agent, or Firm* — Patterson & Sheridan, LLP

(57) ABSTRACT

The present disclosure generally provides an apparatus and method of forming a liquid impermeable sealed audio speaker that can be easily manufactured and provides a high quality audio output. In an effort to overcome the shortcomings of conventional sealed speaker designs that typically utilize complicated and expensive means of shielding their electronic components from liquids and other sources of contamination, one or more of the embodiments of the disclosure provided herein include a sealed enclosure that has at least one liquid impermeable region that prevents or substantially inhibits the movement of a liquid from the exterior region into the internal region. In general, the liquid impermeable regions, or hereafter simply "liquid permeable regions," are configured to prevent the ingress of liquids or other contaminants, while allowing the production of a desired sound quality.

16 Claims, 7 Drawing Sheets

(56) References Cited

U.S. PATENT DOCUMENTS

| | | | | |
|---|---|---|---|---|
| 2006/0163048 | A1* | 7/2006 | Searle | H01H 1/5866 200/302.1 |
| 2012/0008786 | A1* | 1/2012 | Cronk | H04L 63/102 380/282 |
| 2012/0011567 | A1* | 1/2012 | Cronk | H04L 63/102 726/4 |
| 2012/0131833 | A1* | 5/2012 | Lippard | F41A 17/56 42/69.01 |
| 2012/0214575 | A1* | 8/2012 | Amaitis | G06Q 50/34 463/25 |
| 2012/0235036 | A1* | 9/2012 | Hatakeyama | G01N 23/2251 250/310 |
| 2014/0029782 | A1* | 1/2014 | Rayner | H04R 1/2834 381/386 |
| 2015/0125025 | A1* | 5/2015 | Button | H04R 1/00 381/401 |

OTHER PUBLICATIONS

TE2, TE2-connector, 2012, p. 1-5.*
ISC, ISC-overmolding tooling, p. 1.*
ISC, ISC-Overmolding Tooling, p. 1, 2014.*
Hirose, Hirose ZX62W, p. 1-2, 2012.*

* cited by examiner

LIQUID IMPERMEABLE SEALED SPEAKER DESIGN

CROSS-REFERENCE TO RELATED APPLICATIONS

This application claims benefit of U.S. provisional patent application Ser. No. 62/218,502, filed Sep. 14, 2015, which is hereby incorporated herein by reference.

BACKGROUND

Field

Embodiments of the present disclosure generally relate to an audio device and, more specifically, to an apparatus and method of forming a sealed audio speaker assembly.

Description of the Related Art

An important feature in audio speaker design is sound quality. The sound quality produced by a speaker can be directly related to how well the acoustic volume of the speaker is sealed. The seals used in speakers can also be used to prevent the ingress of dirt and water into the internal regions of the speaker housing. Dirt and water can damage the electronics of the speaker as well as reduce the quality of sound produced by the speaker. Preventing the ingress of dirt and water is also important to meet the use requirements of active portable lifestyles of today, such as when the speaker is being used outdoors and is potentially exposed to situations where the speaker may become submerged in water or drenched during water related activities or rain.

While a truly sealed speaker assembly that will not allow liquids or gases to pass in and out of the enclosure can be manufactured, this type of device can be very costly to manufacture. For example, numerous manufacturing steps and materials can be required to seal the openings or ports on the speaker, such as a USB port or an audio port. Furthermore, the seals used for these ports often produce inconsistent results, which lowers yield and drives up the manufacturing cost. Furthermore, a conventional sealed speaker that is not completely liquid-tight, or even gas-tight, will typically have short-term and long-term sound-quality issues and may not be able to reliably meet typical water tight specifications required by consumer electronics manufacturers today.

As small and portable consumer electronic devices become more popular the need for a small liquid proof device that has good sound quality, has a low production cost, and is more easily manufactured has increased in recent years. Therefore, there is need for an enclosed and liquid tight sealed audio speaker design that provides a high-quality sound output and is easily manufactured. The devices, systems, and methods disclosed herein are designed to overcome these deficiencies.

SUMMARY

The present disclosure generally provides an apparatus and method of forming a liquid impermeable sealed audio speaker that can be easily manufactured and provides a high quality audio output. Embodiments disclosed herein generally relate to an audio speaker design and a method of manufacturing an audio speaker.

Embodiments of the disclosure may also provide an audio speaker, comprising a housing enclosing an interior region, the housing including an opening, a speaker assembly sealably mounted to the housing, a connection assembly sealing the opening of the housing, the connection assembly comprising one or more connectors providing an electrical connection between an electrical component disposed in the interior region and an electrical device disposed in an external region outside the housing, and a first body overmolded onto the one or more connectors.

Embodiments of the disclosure may also provide a method of manufacturing an audio speaker, comprising forming a first body over one or more connectors of a connection assembly, wherein forming the first body comprises overmolding a body material over the one or more connectors, positioning the connection assembly within an opening formed in a housing, wherein the housing encloses an interior region and the one or more connectors provide an electrical connection through the opening to the interior region from an external region outside the housing, and the positioning the connection assembly within the opening in the housing forms a seal between the first body and the housing, and mounting a speaker assembly to the housing.

Embodiments of the disclosure may also provide a method of manufacturing an audio speaker, comprising overmolding a first body onto one or more connectors to form a connection assembly, overmolding at least a portion of a housing onto the connection assembly, and mounting a speaker assembly to the housing.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally provides an apparatus and method of forming a liquid impermeable sealed audio speaker that can be easily manufactured and provides a high quality audio output. In an effort to overcome the shortcomings of conventional sealed speaker designs that typically utilize complicated and expensive means of shielding their electronic components from liquids and other sources of contamination, one or more of the embodiments of the disclosure provided herein include a sealed enclosure that has at least one liquid impermeable region that prevents or substantially inhibits the movement of a liquid from the exterior region into the internal region. In general, the liquid impermeable regions, or hereafter simply "liquid permeable regions," are configured to prevent the ingress of liquids or other contaminants, while allowing the production of a desired sound quality.

Figure 1A:
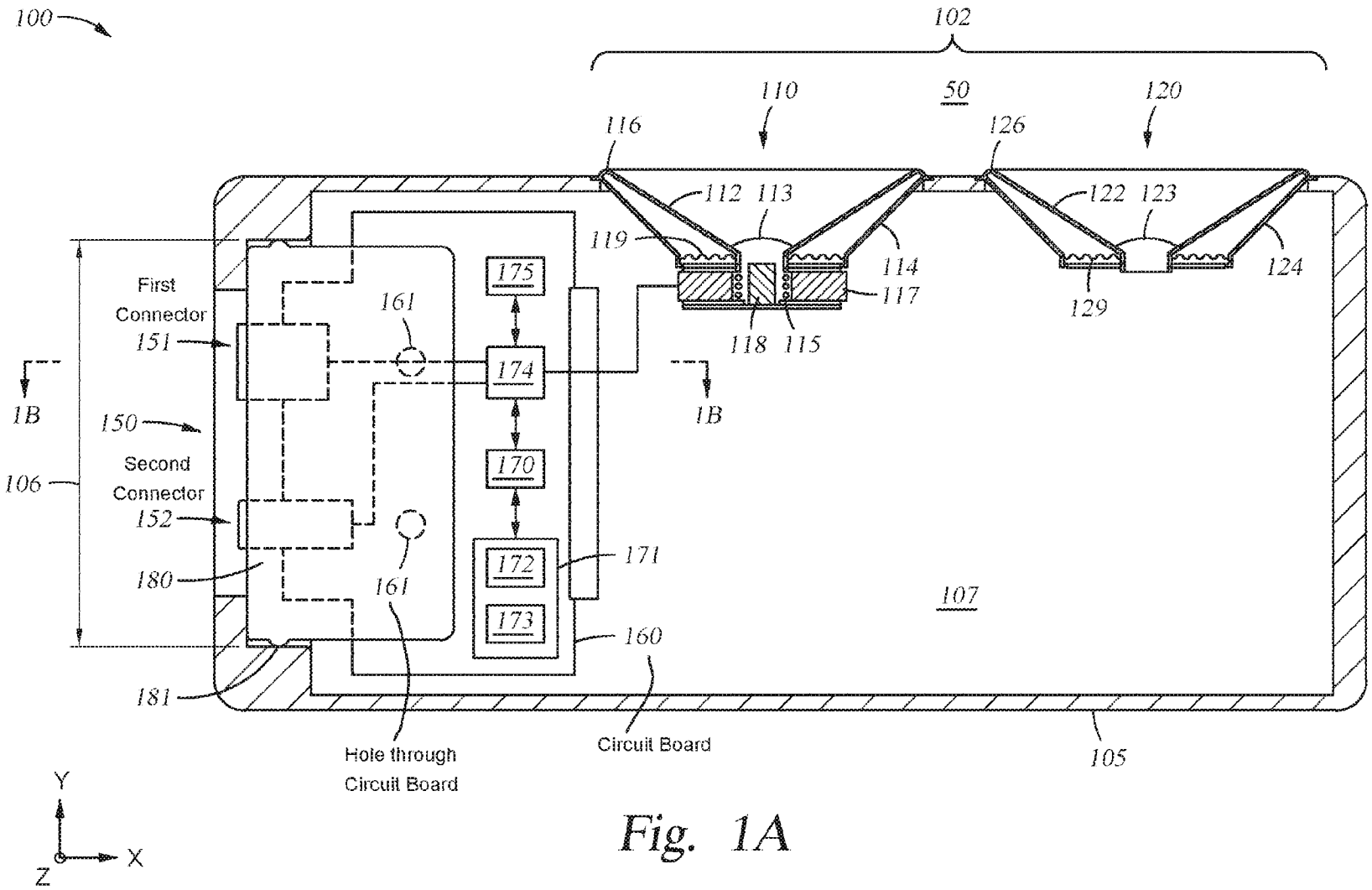
FIG. 1A is a side cross-sectional view of an audio speaker, according to one embodiment.

FIG. 1A is a side cross-sectional view of an audio speaker 100, according to one embodiment. The audio speaker 100 includes a housing 105, a speaker assembly 102, and a connection assembly 150.

The housing 105 encloses an interior region 107 of the audio speaker 100 separating the interior region 107 of the housing 105 from an external region 50 outside the housing 105. The housing 105 includes an opening 106 for connecting to inputs and outputs (I/O), such as an external electronic device (not shown) that can deliver power or send audio data, such as an audio signals or audio files, to the speaker 100. The connection assembly 150 seals the opening 106 of the housing 105. For example, the connection assembly 150 can be used to create a water-tight or air-tight seal of the opening 106. The housing 105 can be formed of, for example, acrylonitrile butadiene styrene (ABS), polycarbonate (PC), PC-ABS, nylon, styrene, acrylic, methyl methacrylate ABS or other similar structural material. In some embodiments, the housing can alternatively be formed of wood, an engineered wood, such as medium density fiberboard, or a metal, such as cold rolled steel or aluminum.

The connection assembly 150 includes one or more connectors 151, 152 for providing a connection through the opening 106 from the interior region 107 to an external device (not shown) located in the external region 50 outside of the housing 105. For example, in one embodiment the first connector 151 is a universal serial bus (USB) connector and the second connector 152 is an audio jack, such as a 2.5 mm or a 3.5 mm audio jack. The connectors 151, 152 are shown using dashed lines in FIG. 1A to show how a first body 180 (discussed in detail below) is formed over the connectors 151, 152.

The connection assembly 150 can further include a circuit board 160, such as a printed circuit board (PCB). In some embodiments, the circuit board 160 includes electronics and/or wiring for handling the signals between the speaker 100 and any I/O attached to the speaker 100. The circuit board 160 is also used to signals to the speaker assembly 102. Portions of the circuit board 160 are shown using dashed lines to indicate parts of the circuit board 160 that are covered by the first body 180 (described in detail below).

In one embodiment, as shown in FIG. 1A, the circuit board 160 can further include electronics for operating the speaker 100. For example, the circuit board 160 can include a processor 170 coupled to input/output (I/O) components 174, a power source 175 (e.g., battery) and a memory unit 171. The memory unit 171 may include one or more software applications 172 and stored media data 173. Processor 170 may be a hardware unit or combination of hardware units capable of executing software applications and processing data, which may, for example, including the delivery of audio information from the speaker 100. In some configurations, the processor 170 includes a central processing unit (CPU), a digital signal processor (DSP), an application-specific integrated circuit (ASIC), and/or a combination of such units. The processor 170 is generally configured to execute the one or more software applications 172 and process the stored media data 173, which are each included within memory unit 171.

The memory unit 171 may be any technically feasible type of hardware unit configured to store data. For example, the memory unit 171 could be a hard disk, a random access memory (RAM) module, a flash memory unit, or a combination of different hardware units configured to store data. The software application 172, which is stored within the memory unit 171, includes program code that may be executed by processor 170 in order to perform various functionalities associated with the audio speaker 100.

The I/O components 174 are coupled to processor 170 and may include components capable of receiving input and/or devices capable of providing output. For example, the I/O components 174 are coupled to the speaker assembly 102, which is configured to generate an acoustic output. The I/O components 174 may also include one or more transceivers configured to establish one or more different types of wired communication links, such as a transceiver within a smart phone, portable computer, tablet or other useful electronic device that is connected to one of the connectors 151, 152. The I/O components may also include one or more transceivers configured to establish one or more different types of wireless communication links, such as a Bluetooth or Wi-Fi communication link, with other transceivers residing within other computing devices found within the external region 50, such as a transceiver within a smart phone, portable computer, tablet or other useful electronic device. In some embodiments, the connection assembly 150 does not include a circuit board 160 and instead includes one or more cables to connect the connectors 151, 152 to the internal electronics of the speaker 100.

The connection assembly 150 further includes a first body 180 overmolded onto the one or more connectors 151,152. In some configurations, the material used to form the first body 180 includes a body material that has desirable mechanical properties (e.g., harness (durometer), creep, elongation, etc.) and electrical properties (e.g., resistivity, dielectric strength, etc.), and may meet one or more certification requirements (e.g., UL fire rating), to allow the first body 180 to electrically isolate electrical components and perform one or more useful functions that are described herein. In some embodiments, the body material of the first body 180 can be formed of an elastomer, such as a thermoplastic or thermoset type of polymeric material. For example, in one embodiment, the body material of the first body 180 is formed of an elastomeric material, such as a fluoroelastomer, perfluoroelastomer, butyl rubber, polyester resin, silicone, or other useful elastomeric material. By overmolding the first body 180 onto the one or more connectors 151, 152, a seal can be created around the connectors 151, 152 to form a liquid impermeable region that is watertight and airtight. Furthermore, this watertight and airtight seal of the first body 180 on the one or more connectors 151, 152 can be formed in one step using one material (i.e., one overmolding step using the elastomeric material). This configuration is an improvement over conventional methods which typically used a process including at least two steps in which an elastomeric body is joined to the connectors using an adhesive.

In one embodiment, the first body 180 is also overmolded onto at least part of the circuit board 160. The overmolding process may include the use of an injection molding process in which the body material is injected into a mold that contains at least a portion of the circuit board 160. In some embodiments, the first body 180 can be overmolded onto most or substantially all of the circuit board 160. By overmolding the first body 180 onto at least part of the circuit board 160, the connectors 151, 152, the circuit board 160, and the first body 180 can be joined together to form one structure (i.e., the connection assembly 150). In some embodiments, the circuit board 160 includes a first set of one or more holes 161 and the first body 180 is overmolded through the first set of one or more holes 161. The holes 161 are shown using dashed lines in FIG. 1A to indicate that the first body 180 is formed over the holes 161. Furthermore, the first body 180 can be overmolded on opposing surfaces of the circuit board 160, such as the top surface of the circuit board 160 shown in FIG. 1A in the bottom surface (not shown) of the circuit board 160. Overmolding the first body 180 through the first set of one or more holes 161 provides greater structural integrity for the connection assembly 150. Furthermore, conventional designs that utilize multiple plastic or elastomeric bodies and adhesives to form a component similar to the first body 180 will make the formed connection assembly 150 more costly to manufacture, the manufacturing process more complex and make the sealing requirements of the design, which are discussed below, unrepeatable and/or unreliable versus one or more of the single piece elastomeric body configurations described herein. Thus, using overmolding to form the first body 180 of the connection assembly 150 allows for designs that are not possible using conventional unmolded component and adhesive containing designs. In some embodiments, the overmolding process can be completed at temperatures around 400° F. and low pressures, such as pressures around 400 psi, so that the electronic components on the circuit board 160 are not damaged during the first body 180 formation process.

The connection assembly 150 can be used to seal the opening 106 of the housing 105. A portion of the first body 180 can be used to form the seal between the housing 105 and the connection assembly 150. For example, the first body 180 can include a sealing feature 181 to contact the portions of the housing 105 that surround the opening 106. In some embodiments, the sealing feature 181 can have a non-flat surface, or raised feature (e.g., semicircular raised feature (not shown)), for contacting and forming a seal with the housing 105. The contact point or contact region at the surface of the sealing feature 181 and the housing 105 can be formed to allow for the deformation of at least the body material of the first body 180 so that a reliable seal can be formed therebetween. Thus, the sealing feature 181 formed to create a watertight and airtight mechanical seal between the first body 180 and the housing 105. Using the sealing feature 181 is only one example of how the mechanical seal may be created between the first body 180 and the housing 105. For example, in another embodiment the circuit board 160 can be fastened to the interior portion of the housing causing a portion and/or surface of the first body 180 to contact and/or form a seal against a recessed surface 110 (FIG. 1B) of the housing 105, in the X-direction, at the opening 106.

Moreover, in some embodiments, the housing 105 and sealing feature 181 of the first body 180 are configured to allow rapidly changing gas pressures generated by the movement of the diaphragm 112 of the speaker assembly 110 to be formed within the internal region 107. The ability of the sealing feature 181 of the first body 180 (e.g., ridge) to form a seal against the housing 105, without the presence of leaks formed therethrough, will generally allow the speaker 100 to generate a desired sound quality. Therefore, in some configurations the sealing features, such as the sealing feature 181 of the first body 180, are formed to allow audible sounds at frequencies greater than 20 hertz (Hz), and generated transient pressures as high as 100 psig, to be formed within the internal region 107. In one configuration, the sealing features are shaped and formed to preferentially allow a higher pressure to be formed in the internal region 107 versus the external region 50.

The speaker assembly 102 can include an active speaker assembly 110 and a passive speaker assembly 120 that can both be sealably mounted to the housing 105. The active speaker assembly 110 can be coupled to the circuit board 160. For example the active speaker assembly 110 can receive audio signals from the I/O components 174 of the circuit board 160. The active speaker assembly 110 generally includes a sealed diaphragm 112, a frame 114, a sealed surround 116, a voice coil 115, a pole piece 118, a permanent magnet 117, a dust cover 113 and a spider 119. During operation, the I/O components deliver a signal to the active speaker assembly 110, which causes the voice coil 115 to move the diaphragm 112 relative to the enclosure housing 105 (i.e., +/−Y-direction) due to the varying magnetic field generated by the voice coil 115 reacting against the magnetic field provided by the permanent magnet 117. In some embodiments, the sealed diaphragm 252 includes a diaphragm layer and a coating layer that are configured to sealably enclose a portion of the interior region 107. The diaphragm layer may include a paper, polymer, metal or other material that is light weight and has a desired stiffness for the size of the audio speaker 100. The coating layer can includes a material (e.g., polymer) that is used to coat a surface of the sealed diaphragm 112 to assure that air or a liquid will not pass through the sealed diaphragm 112.

The passive speaker assembly 120 can be, for example, a passive radiator. Typically, the passive speaker assembly 120 is similar to the active speaker assembly 110 but does not include the active components, such as the voice coil, permanent magnet, and pole piece. The passive speaker assembly 120 generally includes a sealed diaphragm 122, a frame 124, a sealed surround 126, a dust cover 113 and a spider 119. The passive speaker assembly 120 moves in response to the changes in air pressure of the interior region 107 caused by the movements of the active speaker assembly 110.

Figure 1B:
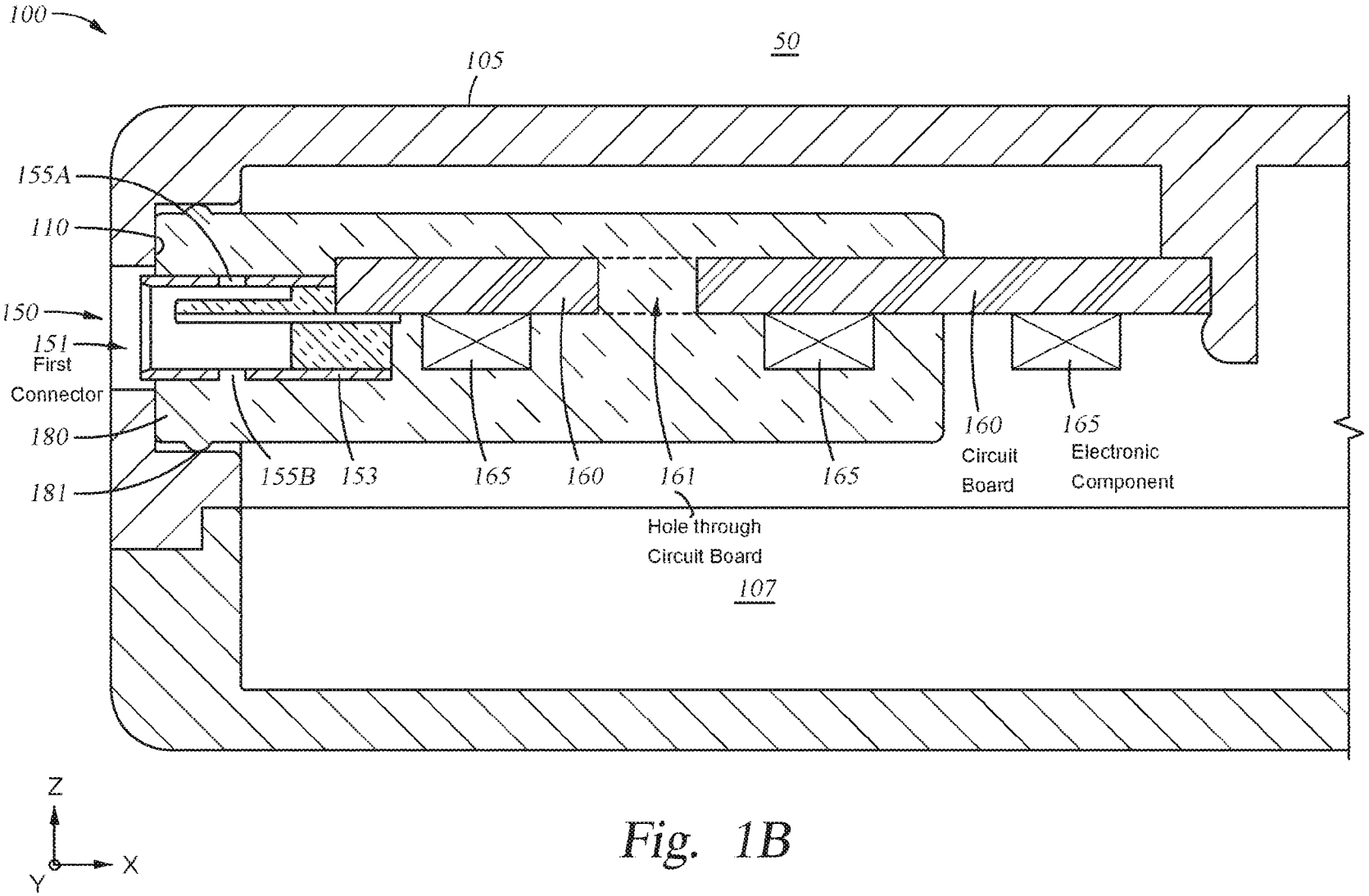
FIG. 1B is a close-up side cross-sectional view of the audio speaker, according to the embodiment of FIG. 1A.

FIG. 1B is a close-up side cross-sectional view of the audio speaker 100 along the line 1B of FIG. 1A. The view shown in FIG. 1B is rotated 90° with respect to the views shown in FIG. 1A. The section line 1B of FIG. 1A extends through the first connector 151. FIG. 1B shows a simplified version of the first connector 151, which as described above can be a USB connector. The connector 151 can include a frame 153. The frame 153 of the connector 151 can include one or more openings 155. Generally these openings 155 can be locations at which an airtight or watertight seal is not present on the connector alone. However, in the present embodiment, the first body 180 can be overmolded over and/or through at least a portion of the openings 155 on the connector 151, as well as any other connectors, to make an airtight and watertight seal at these openings 155. For example, the first body 180 is shown as being overmolded over the opening 155A and through the opening 155B to seal these openings 155A, 155B. It is possible to use waterproof connectors that do not have any openings, but these waterproof connectors can be five times or more expensive than standard connectors. Thus, the overmolding process described herein allows standard connectors to be sealed while also creating a seal for the whole connection assembly 150 in one step.

The circuit board 160 includes one or more electronic components 165, such as the processor 170, memory unit 171, as well as simpler components, such as resistors and capacitors. The first body 180 can be overmolded onto the one or more of the electronic components 165. In some embodiments, the first body 180 can be overmolded onto all of the electronic components 165, so that all of the electronic components 165 can be protected from water and mechanical stresses, such as vibration. Overmolding the first body 180 over one or more of the electronic components 165 provides additional protection for these electronic components 165 from damage caused by, for example, water and mechanical stresses (e.g., when the speaker 100 is dropped). Thus, the first body 180 can be used to seal the opening 106 of the housing 105, seal the connectors having openings 155, and protect electronic components 165 letter overmolded, and this first body 180 can be formed in one overmolding step. The apparatus and processes described herein will also reduce the complexity of the speaker 100 assembly and methods of forming the same, since the connection assembly 150 generally includes a single part that contains the first body 180, connectors 151-152 and the circuit board 160.

Figure 2:
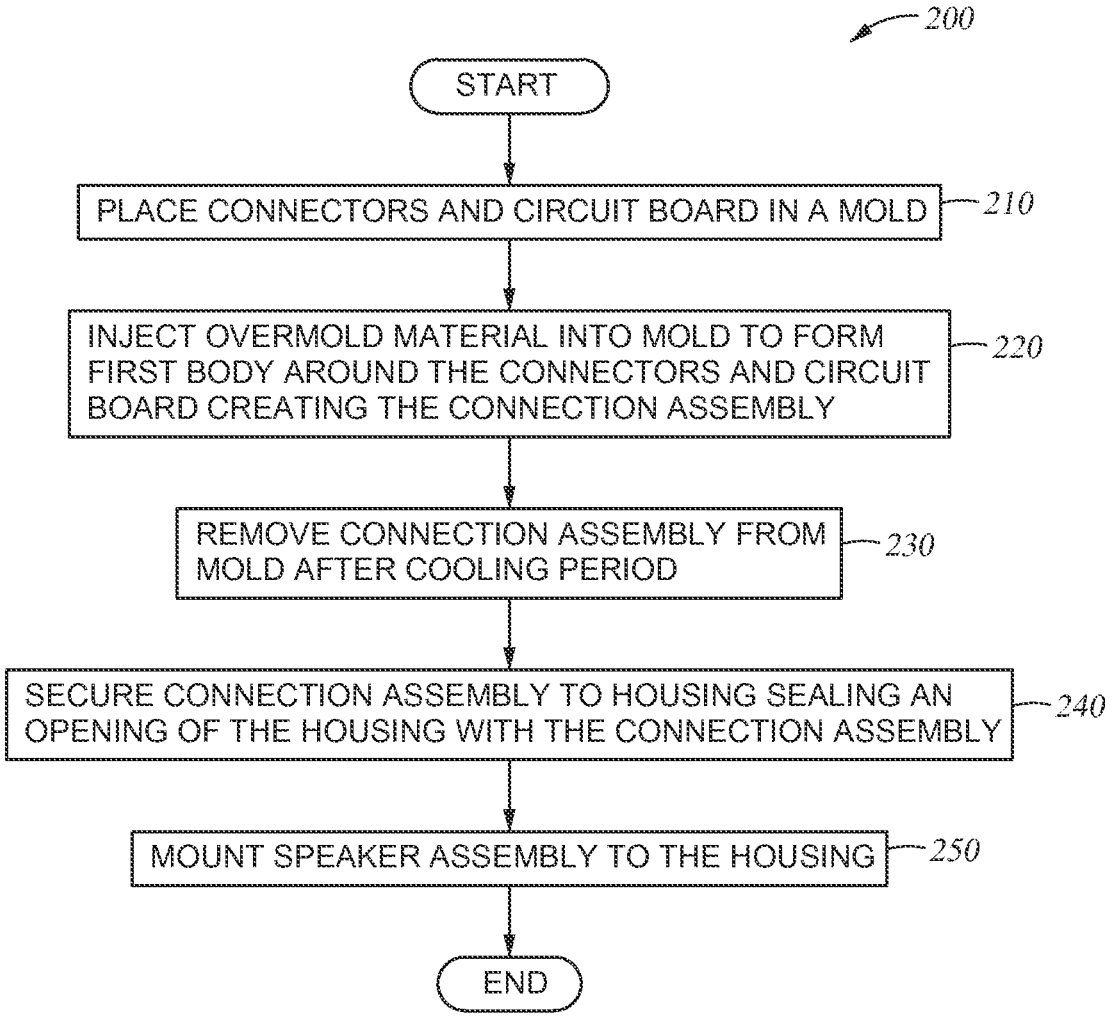
FIG. 2 is a process flow diagram of a method for manufacturing the audio speaker, according to the embodiment of FIG. 1A.

FIG. 2 is a process flow diagram of a method 200 for manufacturing the audio speaker 100, according to the embodiment of FIG. 1A. Although the method 200 is described in reference to the blocks shown on FIG. 2, persons skilled in the art would understand that the method steps in other suitably adapted orders is also within the scope of the embodiments disclosed. At block 210, the connectors 151, 152 and the circuit board 160 are placed into a mold. The mold that the connectors 151 152 and the circuit board 160 are placed into can be specifically designed to overmold the first body 180 onto the connectors 151, 152 and the circuit board 160. The mold can be formed of a metal, such as steel or aluminum. In some embodiments, the first mold is designed so that portions of the connectors 151, 152 and the circuit board 160 are not overmolded. For example, portions of the circuit board 160 which are to be connected to the speaker assembly 102 may not be overmolded. Furthermore the inside of the connectors 151, 152 may not be filled with overmold material. In other embodiments, an insert is placed inside or over portions of the connectors 151, 152 before the overmold material is injected into the mold. For example, in one embodiment, a shielding material, such as heat shrink tubing, is placed over the connectors 151, 152, and then he is applied to secure the tubing over the connectors 151, 152 before the first body 180 is formed. Furthermore, in some embodiments the circuit board 160 and/or the connectors 151, 152 may be plasma treated before the overmolded material is injected into the mold to promote bonding between the first body 180 with the circuit board 160 and/or the connectors 151, 152. The plasma treatment may include placing the circuit board 160 in a vacuum environment and then capactively or inductively delivering RF power to a gas within the processing region of the treatment chamber to form a plasma therein that then interacts with one or more surfaces of the circuit board 160.

At block 220, overmold material is injected into the mold to form the first body 180 around the connectors 151, 152 and the circuit board 160 to create the connection assembly 150. The overmold material, or body material, can be an elastomeric material as described above. In some embodiments, the mold can be used to form multiple connection assemblies 150 at the same time. The overmold material between the connection assemblies 150 can subsequently be removed and reused. At block 230, the connection assembly 150 is removed from the mold, for example, after a cooling period.

At block 240, the connection assembly 150 is secured to the housing 105 to seal the opening 106 of the housing 105 with the connection assembly 150. For example, in one embodiment a portion of the circuit board 160 is fastened to a portion of the housing 105 in a position that causes the sealing feature 181 of the first body 180 to press against the surface of the housing 105 surrounding the opening 106. At block 250, the speaker assembly 102 is mounted to the housing 105. The circuit board 160 may be connected to the active speaker assembly 110 at this time.

Figure 3:
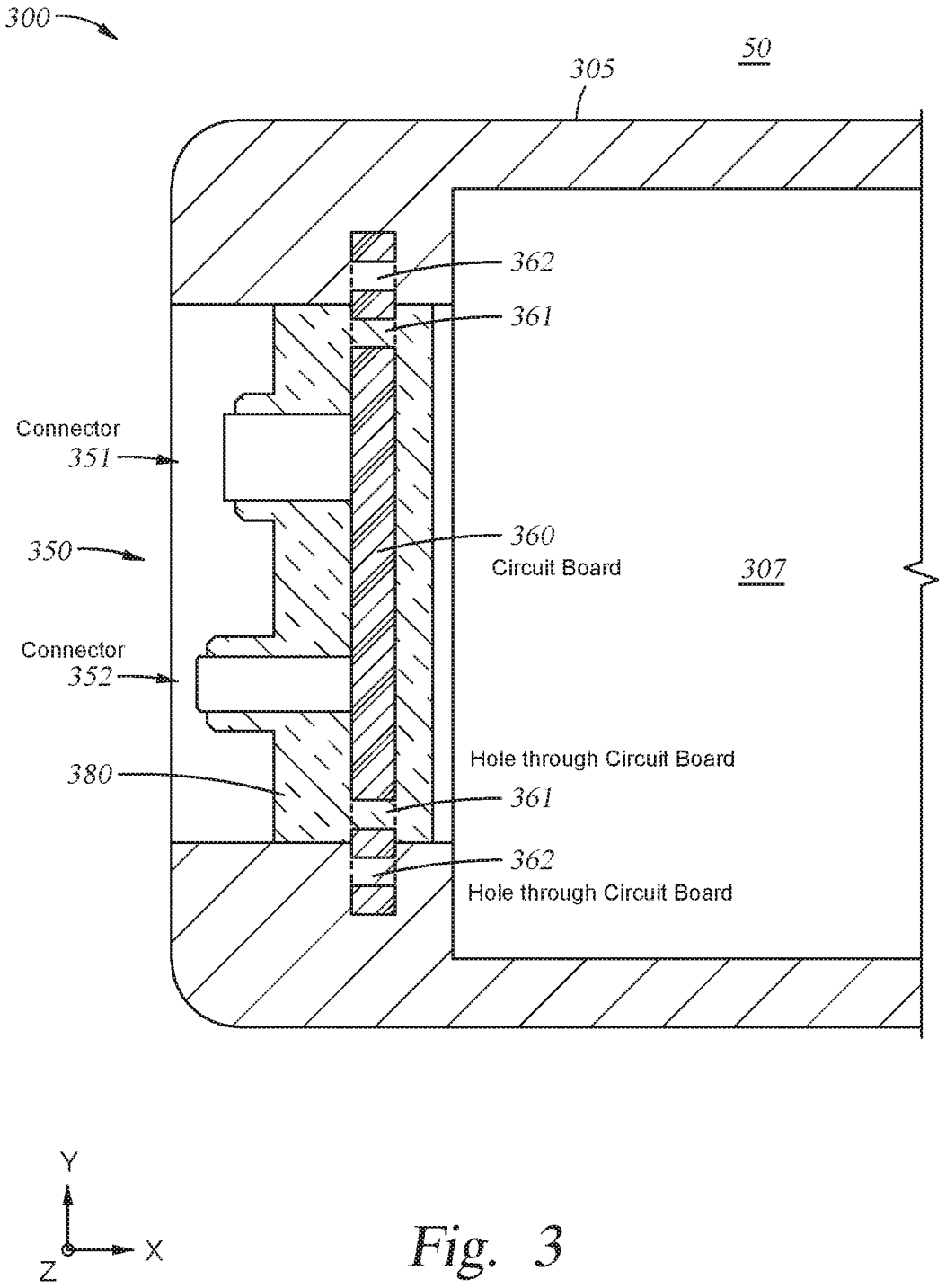
FIG. 3 is a side cross-sectional view of an audio speaker, according to another embodiment.

FIG. 3 is a side cross-sectional view of an audio speaker 300, according to another embodiment. The audio speaker 100 includes a housing 305 enclosing an interior region 307, a speaker assembly (not shown) similar to the speaker assembly 102 of the audio speaker 100, and a connection assembly 350 including connectors 351, 352, a circuit board 360, and a first body 380. In this embodiment, at least a portion of the housing 305 is overmolded onto the connection assembly 350. For example, at least a portion of the housing 305 can be overmolded onto the first body 380 and/or onto the circuit board 360. In the embodiment shown, at least a portion of the housing 305 is overmolded to the first body 380, the circuit board 360, and through one or more holes 362 of the circuit board 360. The one or more holes 362 are shown as being part of the circuit board 360, but in other embodiments the one or more holes 362 could be part of another portion of the connection assembly 350, such as part of the first body 380. The first body 380 is overmolded onto the connectors 351, 352, onto the circuit board 360, and through one or more holes 361 of the circuit board 360. Thus, by using two overmolding steps of overmolding the first body 380 on the connectors 351, 352 and the circuit board 360 to form the connection assembly 350, and then overmolding at least a portion of the housing 305 on the connection assembly 350, a single structure can be created in which the connection assembly 350 is joined to the housing 305 in an airtight and watertight fashion. In one embodiment, a separate end region of the housing 305 is overmolded onto the connection assembly 350, and then in a subsequent part of the manufacturing process, this end region is secured to the remainder of the housing 305. For example, in one embodiment, the end region of the housing 305 includes internal threads designed to receive external threads from the remainder of the housing 305. A seal may also be included in this threaded connection to ensure that the housing 305 is airtight and watertight.

The remainder of the audio speaker 300 is largely similar to the audio speaker 100. For example, the speaker assembly of the audio speaker 300 can be the same as the speaker assembly 102 shown in FIG. 1A. Furthermore, the circuit board 360 can include the same electronic components (e.g., the processor 170) as the circuit board 160 shown in FIG. 1A. In this non-limiting example, one difference between the audio speaker 300 shown in FIG. 3 and the audio speaker 100 configurations discussed above is that the circuit board 360 of the audio speaker 300 is rotated 90° relative to the circuit board 160 of the audio speaker 100. For example, the surface of the circuit board 160 on which the electronic components (e.g., the processor 170) of the audio speaker 100 were mounted extended in the X-direction, and the surface of the circuit board 360 on which the electronic components (e.g., the processor not shown) of the audio speaker 300 are mounted extends in the Y-direction. The rotation of the circuit board 360 relative to the circuit board 160 is an optional configuration, and thus is not intended to limiting as to the scope of the disclosure provided herein.

Figure 4:
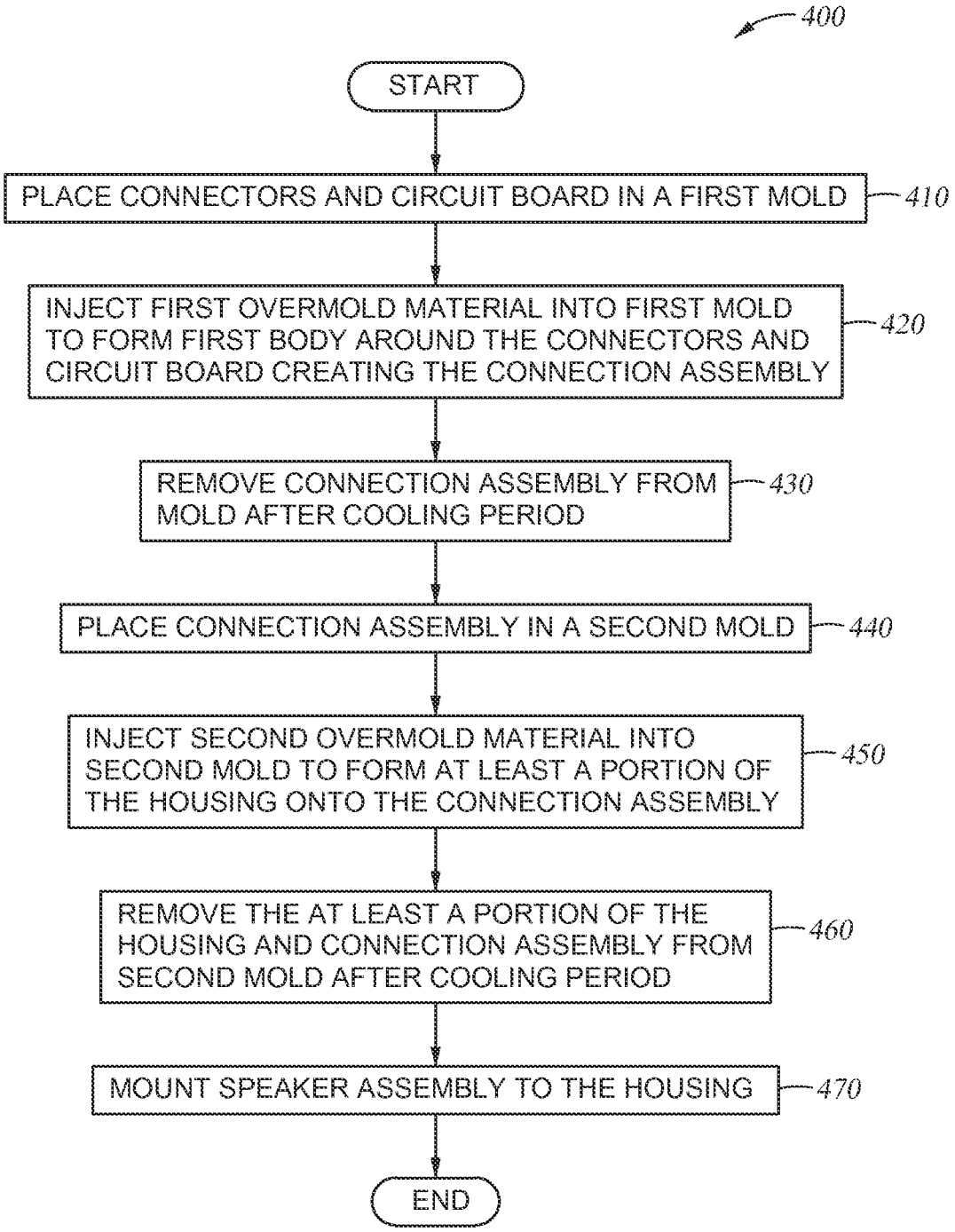
FIG. 4 is a process flow diagram of a method for manufacturing the audio speaker, according to the embodiment of FIG. 3.

FIG. 4 is a process flow diagram of a method 400 for manufacturing the audio speaker 300, according to the embodiment of FIG. 3. Although the method 400 is described in reference to the blocks shown on FIG. 4, persons skilled in the art would understand that the method steps in other suitably adapted orders is also within the scope of the embodiments disclosed. At block 410, the connectors 351, 352 and the circuit board 360 are placed into a first mold. The first mold that the connectors 351 352 and the circuit board 360 are placed into can be specifically designed to overmold the first body 380 onto the connectors 351, 352 and the circuit board 360. The first mold can be formed of a metal, such as steel or aluminum. In some embodiments, the mold is designed so that portions of the connectors 351, 352 and the circuit board 360 are not overmolded. For example, portions of the circuit board 360 which are to be connected to the speaker assembly may not be overmolded. Furthermore the inside of the connectors 351, 352 may not be filled with overmold material. In other embodiments, an insert is placed inside or over portions of the connectors 351, 352 before the overmold material is injected into the first mold. For example, heat shrink tubing may be used as described above in reference to the connectors 151, 152. Furthermore, in some embodiments the circuit board 360 and/or the connectors 351, 352 may be plasma treated before the overmolded material is injected into the first mold to promote bonding between the first body 380 with the circuit board 360 and/or the connectors 351, 352.

At block 420, overmold material is injected into the mold to form the first body 380 around the connectors 351, 352 and the circuit board 360 to create the connection assembly 350. Some of the first body 380 can be formed between a first set of one or more holes 361 of the circuit board 360. The overmold material, or body material, can be an elastomeric material, such as a thermoplastic polymer or other material as described above. In some embodiments, the mold can be used to form multiple connection assemblies 350 at the same time. The overmold material between the connection assemblies 350 can subsequently be removed and reused. At block 430, the connection assembly 350 is removed from the first mold, for example, after a cooling period.

At block 440, the connection assembly 350 is placed in a second mold. The second mold that the connection assembly 350 is placed into can be specifically designed to overmold at least a portion of the housing 305 onto the connection assembly 350. The second mold can be formed of a metal, such as steel or aluminum. In some embodiments, the second mold is designed so that portions of the connection assembly 350 are not overmolded as described above with respect to the first mold.

At block 450, a second overmold material is injected into the second mold to form the at least a portion of the housing 305 around the connection assembly 350. At block 450, the connection assembly 350 and the at least a portion of the housing 305 are processed to form a single structure that forms an airtight and watertight configuration that prevents the ingress of air or water into the interior region 307 of the housing 305 through the connectors 351, 352 or the interface between the connection assembly 350 and the housing 305. Furthermore, in one embodiment, by having the first body 380 overmolded through a first set of one or more holes 361 of the circuit board 360 and by having the at least a portion of the housing 305 overmolded through a second set of holes 362 of the circuit board 360, a structure with a high degree of structural integrity is obtained.

At block 460, the structure including the at least a portion of the housing 305 and the connection assembly 350 is removed from the second mold, for example, after a cooling period. At block 470, the speaker assembly is mounted to the housing 305. The circuit board 360 may be connected to the active speaker assembly at this time.

Figure 5A:
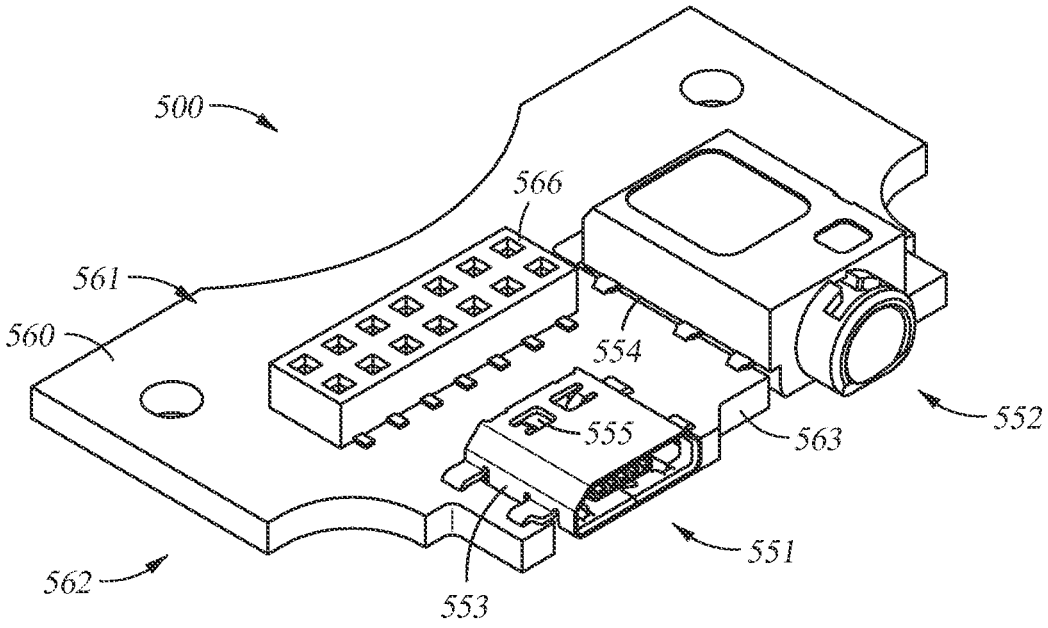
FIG. 5A is a perspective view of a circuit board assembly to be used in an audio speaker, according to another embodiment.

FIG. 5A is a perspective view of a circuit board assembly 500 to be used in an audio speaker, according to another embodiment. The circuit board assembly 500 includes a circuit board 560 and a pair connectors 551, 552 connected to the circuit board 560. In this example, the first connector 551 is a USB connector and the second connector 552 is an audio jack, such as a 2.5 mm or a 3.5 mm audio jack. The circuit board 560 includes a top surface 561, a bottom surface 562 and a front surface 563 between the top surface 561 and the bottom surface 562. The circuit board 560 further includes an internal connector 566 to be disposed in the interior region of the audio speaker when the audio speaker is completely assembled. In some embodiments, the internal connector 566 can be used to connect the circuit board 560 to other components in the audio speaker, such as an active speaker or other electronic elements (e.g., battery, circuit boards). There may be one or more gaps 553 between the first connector 551 and one or more portions of the circuit board 560. There may also be one or more gaps 554 between the second connector 552 and one or more portions of the circuit board 560. The first connector 551 may include one or more openings 555 besides the opening for the cable the first connector was designed to receive. The second connector 552 may also include one or more similar openings (not shown).

Figure 5B:
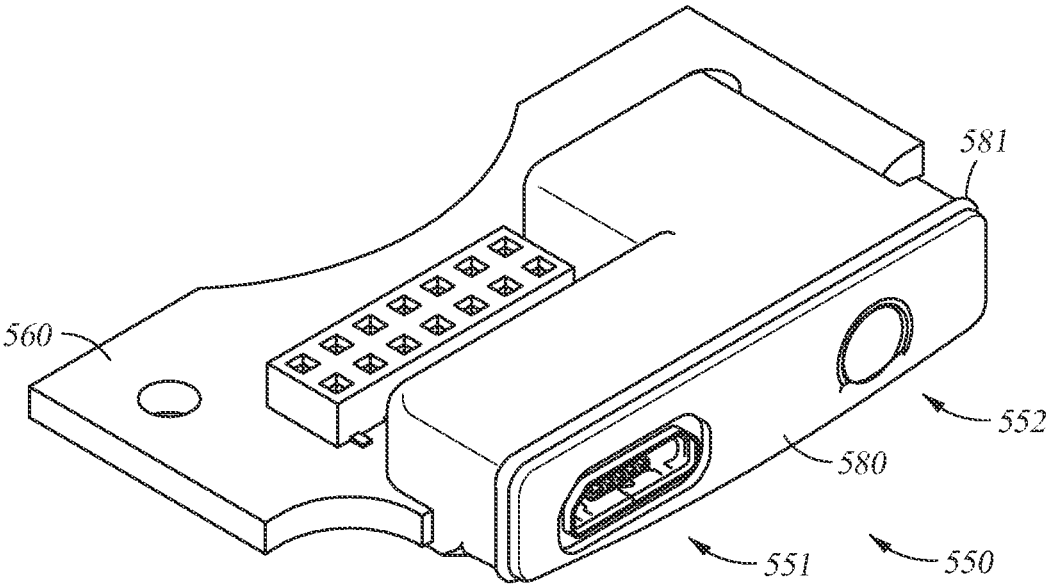
FIG. 5B is a perspective view of a connection assembly including the circuit board assembly of FIG. 5A, according to another embodiment.

FIG. 5B is a perspective view of a connection assembly 550 including the circuit board assembly 500 of FIG. 5A. The connection assembly 550 further includes a first body 580 overmolded onto the circuit board 560 and connectors 551,552. The first body 580 may be formed of similar materials to the first body 180 described above. The first body 580 can be overmolded over portions of the top surface 561 and portions of bottom surface 562 as well as around the front surface 563 of the circuit board 560. The first body 580 can include a sealing feature 581 that is configured to sealably contact portions of the housing of the audio speaker (not shown), such as the schematic illustrations of the similarly configured sealing feature 181 shown in FIGS. 1A and 1B. The first body 580 can be overmolded over and through the gaps 553, 554 between the connectors 551, 552 and the circuit board 560. The first body 580 may also be overmolded over the opening 555 of the first connector 551. Overmolding the first body 580 over and through the gaps 553, 554 and over the opening 555 can create an airtight and watertight seal around the connectors 551, 552.

Figure 6A:
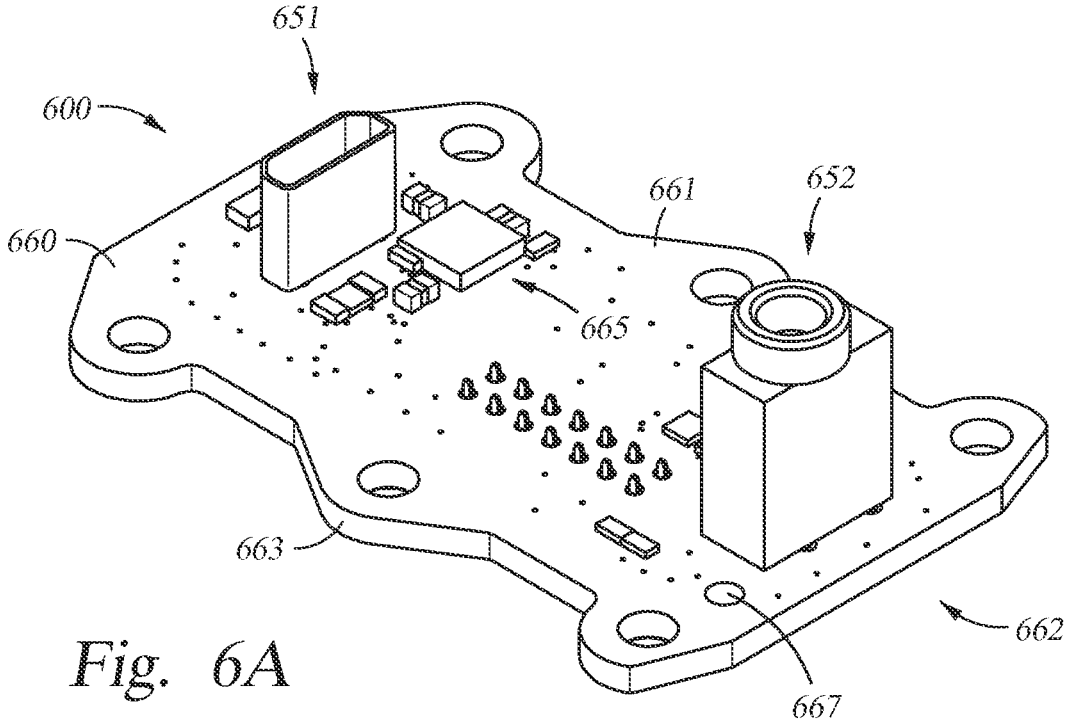
FIG. 6A is a perspective view of a circuit board assembly to be used in an audio speaker, according to another embodiment.

FIG. 6A is a perspective view of a circuit board assembly 600 to be used in an audio speaker, according to another embodiment. The circuit board assembly 600 includes a circuit board 660 and a pair connectors 651, 652 connected to the circuit board 660. In this example, the first connector 651 is a USB connector and the second connector 652 is an audio jack, such as a 2.5 mm or a 3.5 mm audio jack. The circuit board 660 includes a top surface 661, a bottom surface 662 and one or more side surfaces 663 between the top surface 661 and the bottom surface 662. The circuit board 660 further includes one or more electronic components 665. The circuit board 660 may further include one or more holes 667 extending through the circuit board 660 from the top surface 661 to the bottom surface 662.

Figure 6B:
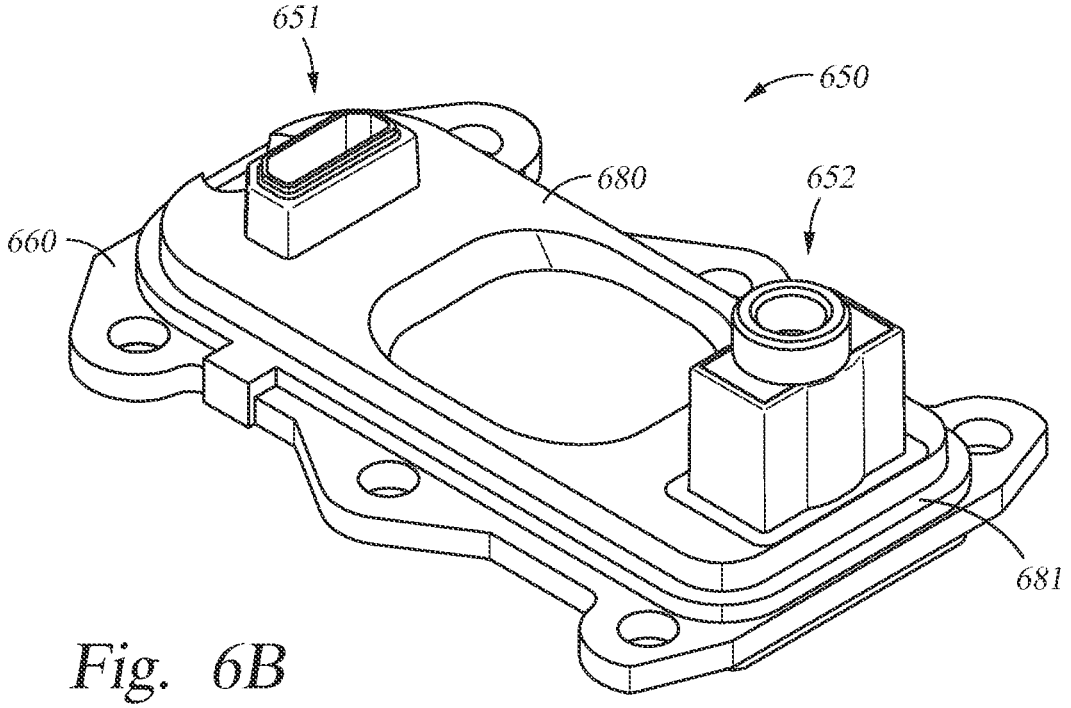
FIG. 6B is a perspective view of a connection assembly including the circuit board assembly of FIG. 6A, according to another embodiment.

FIG. 6B is a perspective view of a connection assembly 650 including the circuit board assembly 600 of FIG. 6A. The connection assembly 650 further includes a first body 680 overmolded onto the circuit board 660 and connectors 651,652. The first body 680 may be formed from similar materials to the first body 180 described above. The first body 680 can be overmolded over portions of the top surface 661 and portions of the bottom surface 662 as well as around one or more of the side surfaces 663. The first body 680 can include a sealing feature 681 to contact portions of the housing of the audio speaker (not shown). The first body 680 can be overmolded over and through the one or more holes 667 and over one or more of the electronic components 665. Overmolding the first body 680 through the one or more holes 667 can improve the structural integrity of the connection assembly 650. Overmolding the first body 680 over the one or more electronic components 665 can provide protection for these electronic components against damage from liquids or mechanical stress, such as vibrations. In one embodiment, an end cap (not shown) can be placed over the connection assembly 650. The end cap can have an opening that surrounds the connection assembly and can also have a surface around the opening that presses against the sealing feature 681. The combination of the end cap and the connection assembly 650 can create a watertight and airtight seal for the interior of the audio speaker.

Although the above disclosure has been directed to creating a speaker having a connection assembly sealed to the housing of the speaker, so that an airtight and watertight seal can be formed around one or more connectors and the housing, further embodiments are contemplated in which similar seals around connectors and the housing of other electronic devices beside speakers can be used to improve such other electronic devices and the methods to produce such electronic devices. Furthermore, although parts of the above embodiments have been described as being airtight and watertight, it is also within the scope of the present disclosure for the embodiments to be protected from other liquids, gases, solids or combinations thereof.

While the foregoing is directed to embodiments of the present disclosure, other and further embodiments of the disclosure may be devised without departing from the basic scope thereof, and the scope thereof is determined by the claims that follow.

What is claimed is:

1. An audio speaker, comprising:

a housing enclosing an interior region, the housing including an opening;

a speaker assembly sealably mounted to the housing;

a connection assembly sealing the opening of the housing to form a watertight seal therebetween, the connection assembly comprising:

one or more connectors providing an electrical connection between an electrical component disposed in the interior region and an electrical device disposed in an external region outside the housing; and a first body comprising an overmolding material that is overmolded onto the one or more connectors, wherein the first body contacts the housing to form the watertight seal, the first body includes a sealing feature disposed against portions of the housing surrounding the opening, and the sealing feature comprises a raised feature consisting essentially of the overmolding material of the first body, and the sealing feature is configured to deform to form the watertight seal when the sealing feature is disposed against the portions of the housing.

2. The audio speaker of claim 1, wherein the connection assembly further comprises a circuit board disposed in the interior region of the housing and coupled to the one or more connectors, wherein the first body is overmolded onto the circuit board.

3. The audio speaker of claim 2, wherein the circuit board includes a first set of one or more holes and the first body is overmolded through the first set of one or more holes.

4. The audio speaker of claim 2, wherein the first body is overmolded so that the overmolding material covers one or more electronic components that are disposed on the circuit board.

5. The audio speaker of claim 1, wherein the housing is overmolded onto at least a portion of the connection assembly.

6. The audio speaker of claim 3, wherein connection assembly includes a second set of one or more holes and the housing is overmolded through the second set of one or more holes.

7. The audio speaker of claim 3, wherein the circuit board includes a second set of one or more holes and the housing is overmolded through the second set of one or more holes.

8. The audio speaker of claim 1, wherein at least one of the connectors includes an opening and the overmolding material of the first body is overmolded over the opening of the at least one connector to seal the opening of the at least one connector.

9. The audio speaker of claim 1, wherein the speaker assembly comprises a passive speaker assembly.

10. A method of manufacturing an audio speaker, comprising:

forming a first body over one or more connectors of a connection assembly, wherein forming the first body comprises overmolding a body material over the one or more connectors;

positioning the connection assembly within an opening formed in a housing, wherein the housing encloses an interior region and the one or more connectors provide an electrical connection through the opening to the interior region from an external region outside the housing, and the positioning the connection assembly within the opening in the housing forms a watertight seal between the first body and the housing, wherein the first body contacts the housing to form the watertight seal the first body includes a sealing feature disposed against portions of the housing surrounding the opening, and the sealing feature comprises a raised feature consisting essentially of the body material, and the sealing feature is configured to deform to form the watertight seal when the sealing feature is disposed against the portions of the housing; and mounting a speaker assembly to the housing.

11. The method of claim 10, wherein the connection assembly further includes a circuit board that is coupled to the one or more connectors, wherein the first body is overmolded onto the circuit board.

12. The method of claim 11, wherein the circuit board includes a first set of one or more holes and the body material is overmolded through the first set of one or more holes.

13. The method of claim 11, wherein the circuit board includes one or more electronic components and the body material is overmolded so that the body material covers the one or more electronic components.

14. The method of claim 10, wherein the speaker assembly includes a passive speaker assembly.

15. The method of claim 10, wherein at least one of the connectors includes an opening and the body material is overmolded through the opening of the at least one connector to seal the opening of the at least one connector.

16. The method of claim 10, wherein at least one of the connectors includes an opening and the body material is overmolded over the opening of the at least one connector to seal the opening of the at least one connector.

* * * * *